US008567009B2

(12) United States Patent
Krebs

(10) Patent No.: US 8,567,009 B2
(45) Date of Patent: Oct. 29, 2013

(54) SUCTION NOZZLE WITH SHUTTLING PLATE AND CONVERGING DEBRIS PATHS

(75) Inventor: Alan J. Krebs, Pierson, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 125 days.

(21) Appl. No.: 13/314,845

(22) Filed: Dec. 8, 2011

(65) Prior Publication Data

US 2012/0151713 A1 Jun. 21, 2012

Related U.S. Application Data

(60) Provisional application No. 61/423,247, filed on Dec. 15, 2010.

(51) Int. Cl.
*A47L 5/00* (2006.01)
*A47L 9/02* (2006.01)

(52) U.S. Cl.
USPC ..... 15/393; 15/399; 15/400; 15/401; 15/403; 15/416; 15/419

(58) Field of Classification Search
USPC ..... 15/393, 398, 400, 401, 403, 416, 419
IPC ..... A47L 5/00,9/02, 9/06
See application file for complete search history.

(56) References Cited

U.S. PATENT DOCUMENTS

| | | | |
|---|---|---|---|
| 7,013,528 | B2 | 3/2006 | Parker et al. |
| 7,337,494 | B2 | 3/2008 | Baer et al. |
| 7,409,745 | B2 | 8/2008 | Dodson et al. |
| 2009/0100636 | A1 | 4/2009 | Sohn et al. |

FOREIGN PATENT DOCUMENTS

| | | | |
|---|---|---|---|
| EP | 2329755 | A2 | 8/2011 |
| JP | 49098152 | U | 8/1974 |
| JP | 7327878 | A | 12/1995 |
| JP | 8140905 | A | 6/1996 |
| KR | 20060008729 | A | 1/2006 |

*Primary Examiner* — David Redding
(74) *Attorney, Agent, or Firm* — McGarry Bair PC

(57) ABSTRACT

A suction nozzle assembly comprises a nozzle body with a slidably supported shuttling plate mounted therebeneath. The shuttling plate selectively directs suction to focused nozzle inlet openings at the front and rear portions of the nozzle body on forward and backward cleaning strokes, respectively. Converging debris paths defined by a plurality of debris guides direct debris towards the focused nozzle inlets. The debris guides further define along the underside of the shuttling plate sheet retention platforms that are isolated from the working air path and have dust cloths to remove dust from the surface.

13 Claims, 7 Drawing Sheets

SUCTION NOZZLE WITH SHUTTLING PLATE AND CONVERGING DEBRIS PATHS

CROSS-REFERENCE TO RELATED APPLICATION

This application claims the benefit of U.S. Provisional Application No. 61/423,247, filed Dec. 15, 2010, which is incorporated herein by reference in its entirety.

BACKGROUND OF THE INVENTION

1. Field of the Invention

The invention relates generally to a suction nozzle of a vacuum cleaner such as an upright, stick, or canister vacuum cleaner. In one of its aspects, the invention relates to a suction nozzle comprising a shuttling plate that selectively directs a working air flow of the vacuum cleaner differently based on a forward stroke or a rearward movement of the suction nozzle. In another of its aspects, the invention relates to a detachable suction nozzle with a shuttling plate slidably affixed to a bottom surface thereof. In yet another aspect, the invention relates to a suction nozzle which is configured to selectively focus suction to one of a plurality of converging debris paths at the front or rear of the nozzle. In yet another of its aspects, the invention relates to a suction nozzle that is adapted to collect debris and dust particles simultaneously from a bare floor.

2. Description of the Related Art

Vacuum cleaners typically have a main nozzle upstream of a suction source to conduct an air stream generated by the suction source and entrain dirt from the surface to be cleaned in the air stream. The main nozzle can also have an agitator to agitate or loosen dirt on the surface to be cleaned. Generally the main nozzle spans the width of the vacuum cleaner and has a relatively consistent distribution of air stream velocity along the width of the nozzle.

BRIEF SUMMARY

According to the invention, a suction nozzle assembly comprises a housing with a suction inlet adapted to be interconnected with a suction source and further having a fixed plate mounted to an underside of the housing and having at least one inlet opening fluidly interconnected with a working air conduit. A shuttling plate having at least one first nozzle inlet and at least one second nozzle inlet is mounted to an underside of the fixed plate for movement between a first position wherein the shuttling plate at least one first nozzle inlet is in fluid register with the fixed plate at least one inlet opening and a second position wherein the shuttling plate at least one second nozzle inlet is in fluid register with the fixed plate at least one inlet opening. The shuttling plate further comprises on an underside thereof debris guides that are configured to guide debris into the at least one first nozzle inlet when the shuttling plate is in the first position and to guide debris into the at least one second nozzle inlet when the shuttling plate is in the second position.

Typically, the shuttling plate at least one first nozzle inlet is out of fluid register with any inlet opening in the fixed plate when the shuttling plate is in the second position and the shuttling plate at least one second nozzle inlet is out of fluid register with any inlet opening in the fixed plate when the shuttling plate is in the first position.

In one embodiment, the shuttling plate has a forward end, a rearward end and sides that extend between the forward and rearward ends, and the debris guides comprise elongated ribs that extend rearwardly and laterally from the forward end to the at least one first nozzle inlet and that extend forwardly and laterally from the rearward end to the at least one second nozzle inlet to focus the debris to the at least one first nozzle inlet as the suction nozzle moves across a surface to be cleaned in a forward direction and to focus debris to the at least one second nozzle inlet as the suction nozzle moves across the surface to be cleaned in a rearward direction. The debris guides can form converging debris paths toward the at least one first nozzle inlet and the at least one second nozzle inlet.

Further, in another embodiment, the debris guides can comprise debris collection elements on a bottom portion thereof. The debris guides can comprise one or more of tufted strip brushes, elastomeric wipers, squeegee blades or hair collecting elements. The hair collection elements can include directional fabric strips or resilient, elastomeric blades or nubs.

In another embodiment, at least a portion of the shuttling plate forms at least one retention platform that is configured to be in frictional contact with the surface to be cleaned during forward and rearward movement of the suction nozzle assembly. In addition, at least one debris-collecting fabric can be mounted to the at least one retention platform in a position to contact the surface to be cleaned to the collect fine dust particles that are not otherwise ingested by the first or second nozzle inlets.

In another embodiment, a plurality of inlet openings can be formed in the fixed plate. In addition, a plurality of first nozzle inlets can be formed in the shuttling plate. In another embodiment, the shuttling plate can include a plurality of second nozzle inlet, and each of the plurality of second nozzle inlets can be aligned with one of the plurality of first nozzle inlets.

In another embodiment, at least one debris-collecting fabric can be mounted to the shuttling plate in a position to contact the surface to be cleaned and configured to collect fine dust particles that are not ingested into the first or second nozzle inlets.

DESCRIPTION OF EMBODIMENTS OF THE INVENTION

Figure 1:
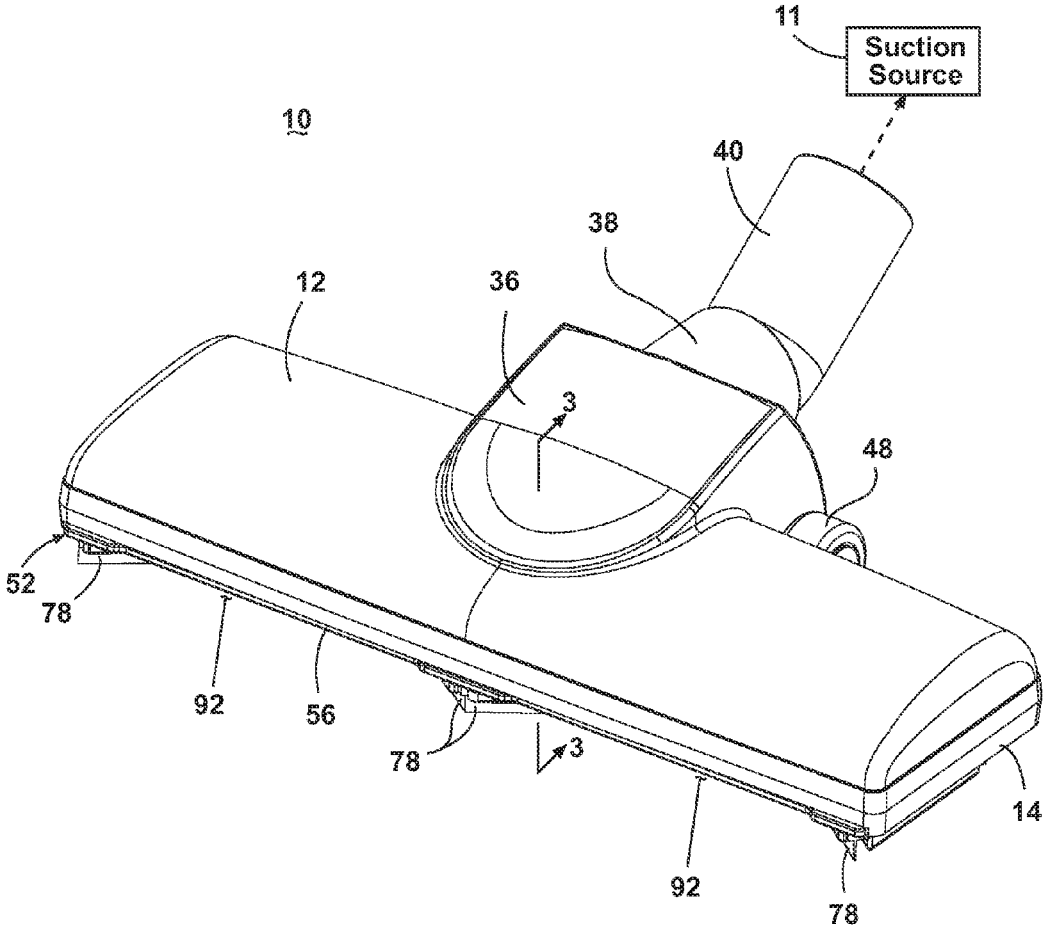
FIG. 1 is a front perspective view of a vacuum cleaner suction nozzle according to a first embodiment of the invention.

For purposes of description related to the figures, the terms "upper," "lower," "right," "left," "rear," "front," "vertical," "horizontal," and derivatives thereof shall relate to the invention as oriented in FIG. 1 from the perspective of a user behind the suction nozzle, which defines the rear of the suction nozzle. However, it is to be understood that the invention can assume various alternative orientations, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
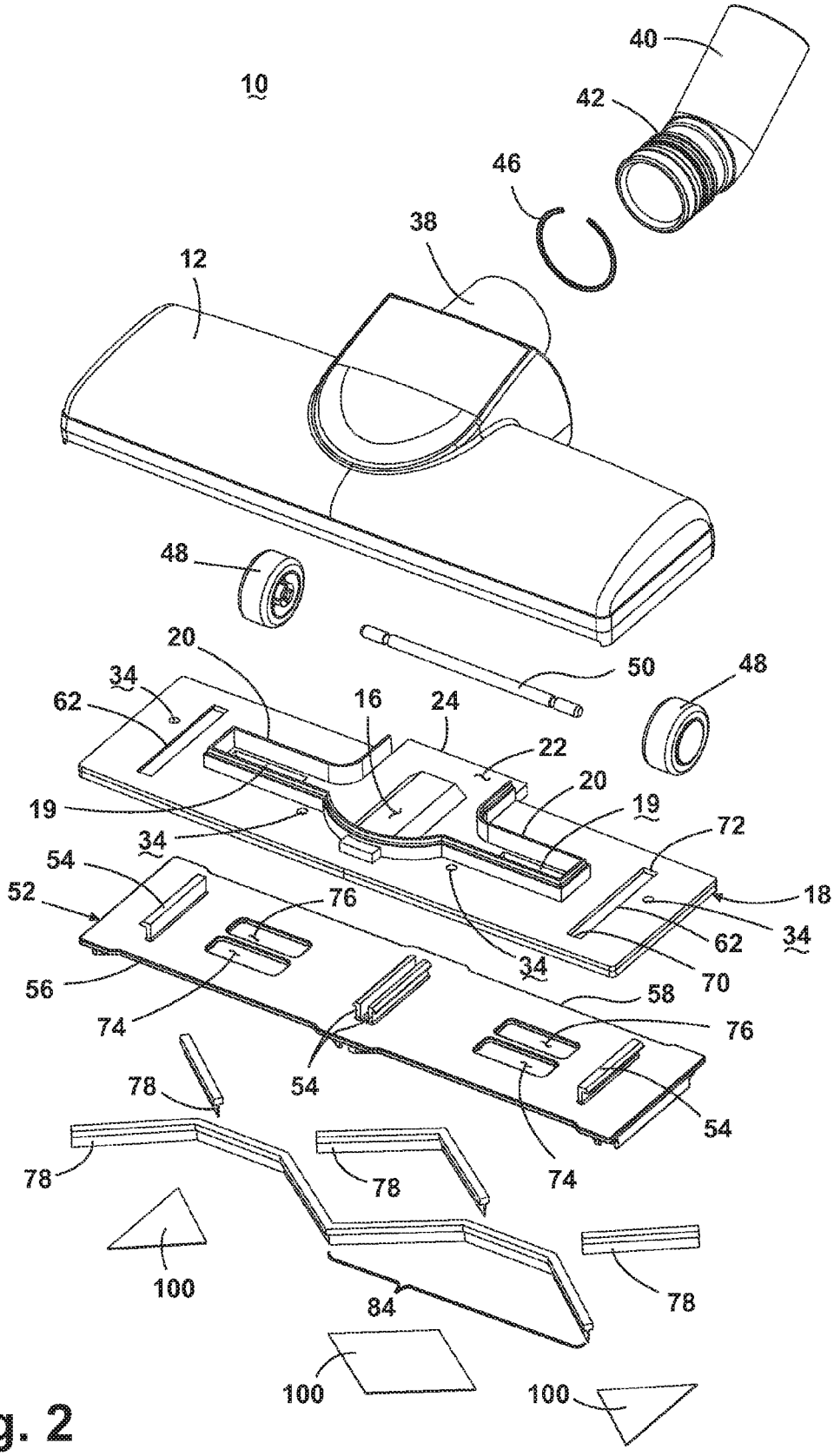
FIG. 2 is an exploded view of the foot assembly of FIG. 1.
Figure 3:
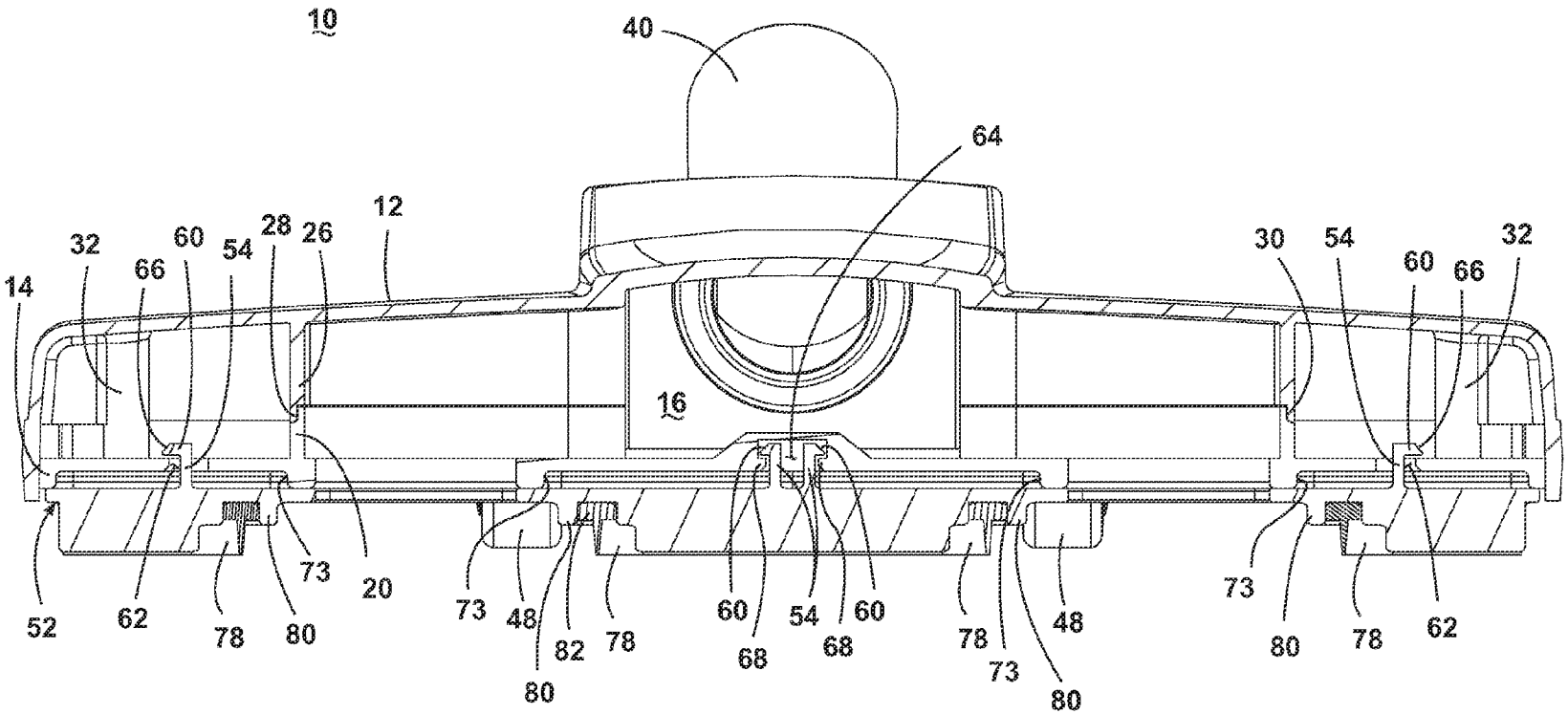
FIG. 3 is a cross-sectional view of the foot assembly of FIG. 1 taken along line 3-3 of FIG. 1.
Figure 4:
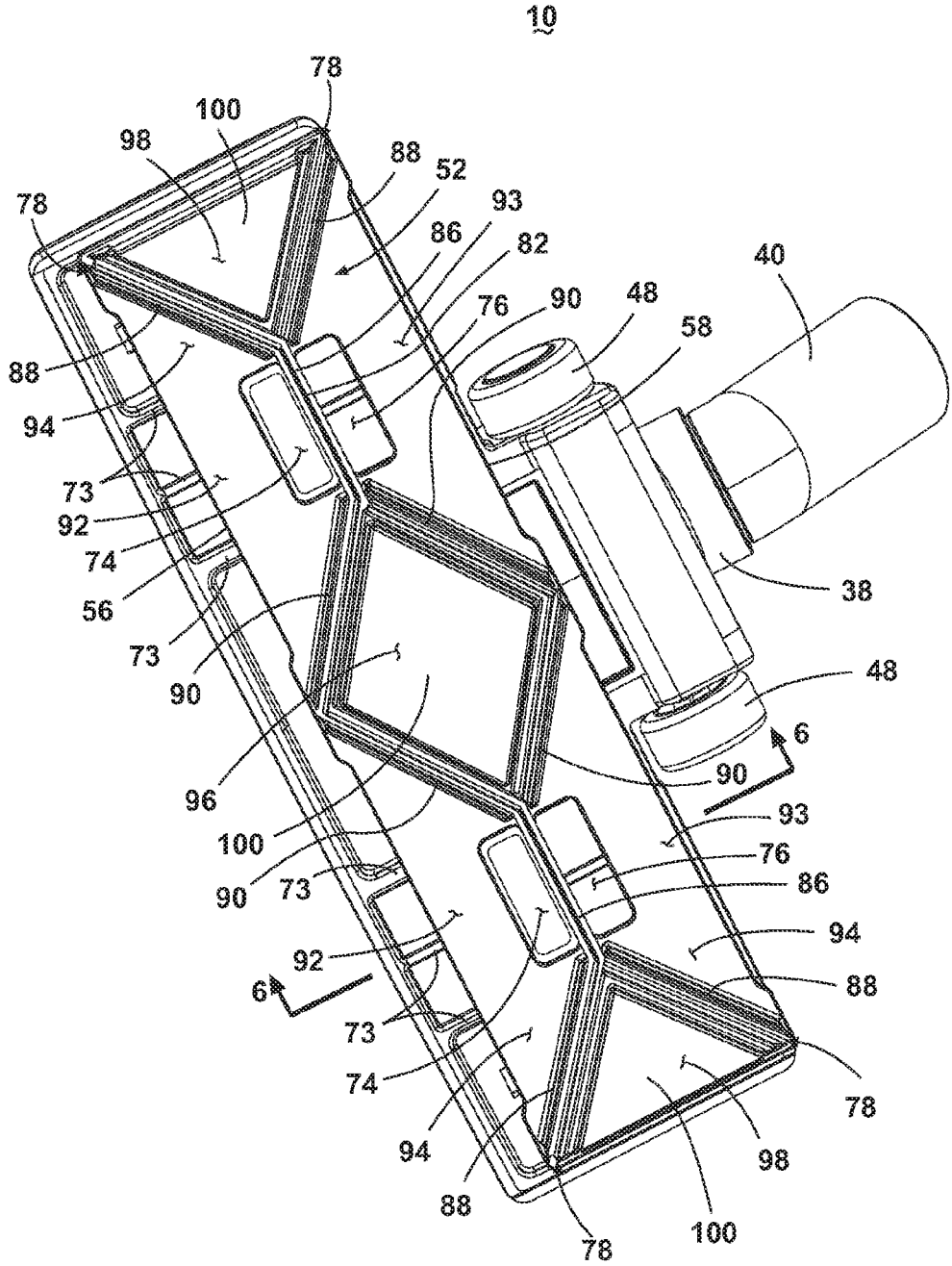
FIG. 4 is a bottom perspective view of the suction nozzle of FIG. 1 with the shuttling plate in the rearward position.
Figure 5:
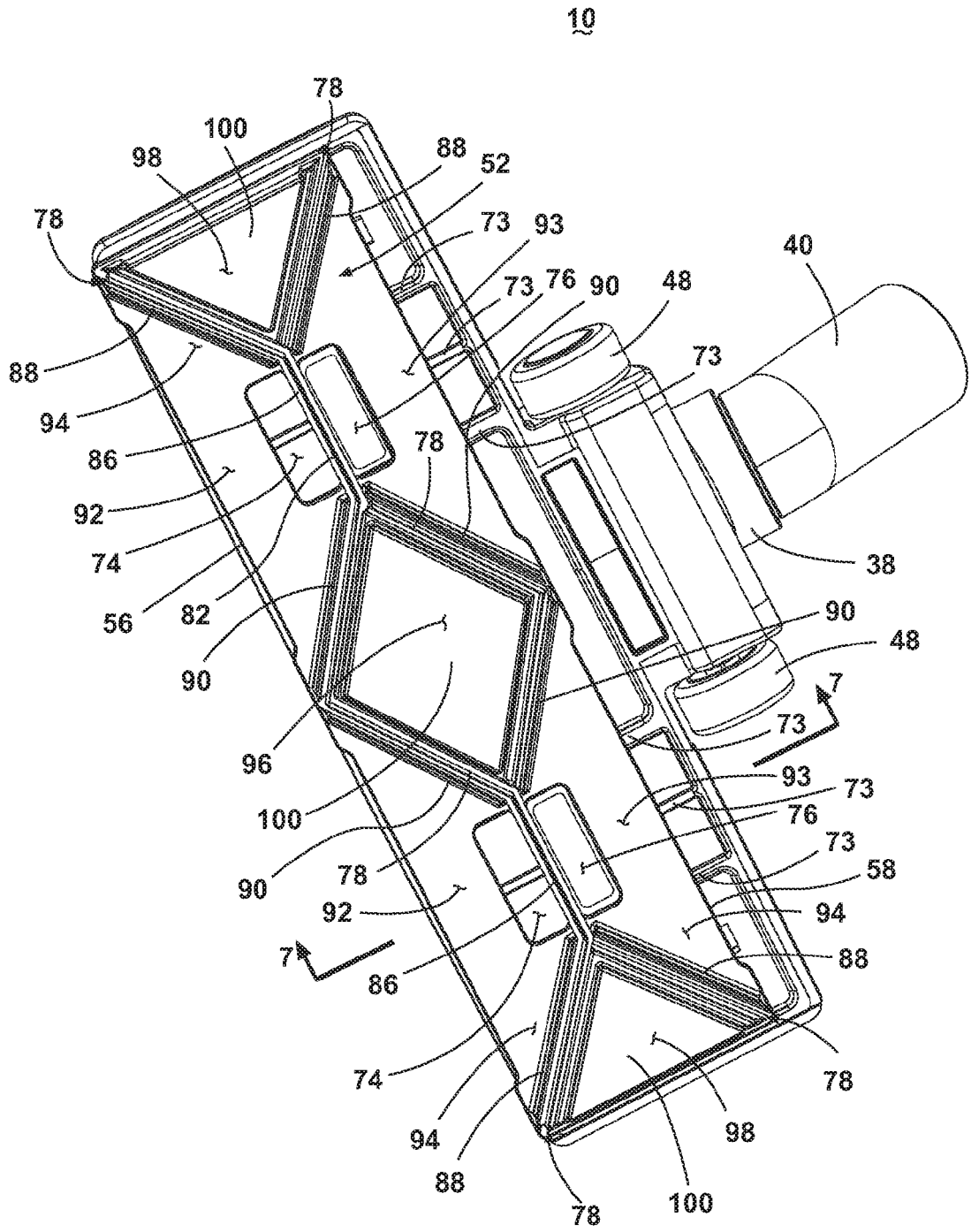
FIG. 5 is a bottom perspective view of the suction nozzle of FIG. 1 with the shuttling plate in the forward position.
Figure 6:
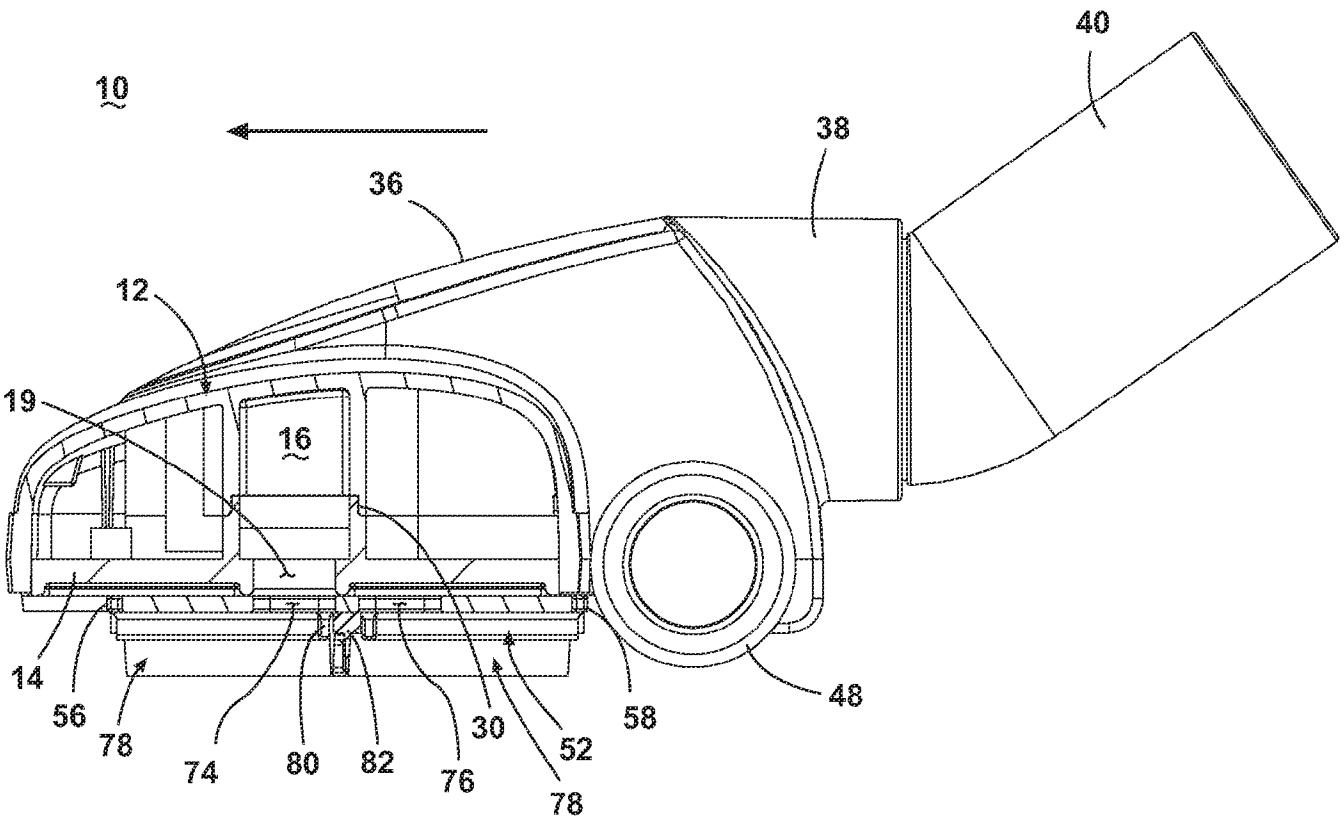
FIG. 6 is a cross-sectional view of the foot assembly taken along line 6-6 of FIG. 4 with a shuttling plate in a rearward position during a forward cleaning stroke.

Referring to FIGS. 1-3, a suction nozzle assembly 10 is adapted for selective connection and fluid communication with a downstream suction source 11 such as an upright, stick or canister vacuum cleaner via a conventional wand and suction hose assembly. The nozzle assembly 10 comprises a top housing 12 secured to a base housing 14, a coupling housing 36 extending rearwardly from the back wall of the top housing 12, and a cylindrical coupler 38 extending rearwardly from an upper portion of the coupling housing 36 and sized to rotatably receive an angled swiveling conduit 40 coupled to the downstream suction source 11. Raised annular retention ribs 42 protrude from the circumference of a proximal end of the swiveling conduit 40. The annular retention ribs 42 are configured to register with corresponding grooves 44 formed around the inner cylindrical surface of the coupler 38 to retain the conduit 40 within the coupler 38, while permitting facile rotation therein. An O-ring seal 46 held between the retention ribs 42 on the proximal end of the swiveling conduit 40 and seals against the inner wall of the coupler 38 to reduce air leaks within the working air path.

Rear wheels 48 are rotatably mounted to an axle 50 that extends through a lower portion of the coupling housing 36. Each wheel 48 comprises a rigid thermoplastic body and can further comprise a resilient, elastomeric tread portion around the circumference that is adapted to contact the surface to be cleaned, improve traction, and limit abrasion of the surface to be cleaned.

The top housing 12 and bottom housing 14 form a working air chamber 16 therebetween that is fluidly coupled to a forward and rearward debris inlet channel 92 and 93 upstream of the air chamber 16 and the to the coupling housing 36, cylindrical coupler 38, angled swiveling conduit 40, and the suction source 11 downstream of the air chamber 16. The base housing 14 is secured to the top housing 12 via conventional fasteners, although alternative attachment means are possible, including adhesive, ultrasonic welding, or a snap fit configuration, for example. The base housing 14 comprises a flat member 18 with a raised vertical rib 20 that surrounds opposed inlet opening 19 in the flat member 18 and forms a portion of a working air chamber 16 therein. The vertical rib 20 protrudes upwardly from the top surface of the flat member 18 and originates and terminates at the sides of a suction outlet 22 along the back edge 24 of the base housing 14 forming a lower portion of the working air chamber 16. The raised vertical rib 20 is adapted to mate with a corresponding upper rib 26 that protrudes downwardly from the top housing 12 that forms an upper portion of the working air chamber 16 when the top housing 12 is mated to the flat member 18. Both ribs comprise a stepped portion 28 at the ends thereof adapted to matingly engage and form a leak proof lap joint 30 around the working air chamber 16 upon assembly of top and base housings 12, 14. The top housing 12 comprises a generally rectangular body further comprising a front wall, rear wall, and opposed sidewalls. Structural ribbing and attachment bosses 32 protrude downwardly from the inner surface of the top housing 12. The bosses 32 are adapted to mate with corresponding mounting holes 34 in the base housing 14.

Continuing with FIGS. 1-3, a shuttling plate 52 is slidably mounted beneath the base housing 14 for movement between a first or forward position and a second or rearward position. The shuttling plate 52 is a generally flat, rectangular member with a forward end, a rearward end and sides and comprising a plurality of L-shaped guide ribs 54 protruding upwardly from the top surface perpendicular to the front and rear edges 56, 58 of the plate 52. Two L-shaped guide ribs 54 are located at the outboard left and right ends of the shuttling plate 52. Additionally, a pair of L-shaped guide ribs 54 are positioned back-to-back near the center of the shuttling plate 52. The free ends of the guide ribs 54 comprise elongate hooks 60 that are adapted to engage corresponding guide slots 62 at the left and right ends of the base housing 14 and a guide channel 64 at the center of the base housing 14.

The top of the outwardly disposed hooks 60 can further comprise an angled lead-in 66 to facilitate assembly of the plate 52 to the base housing 14. The hooks 60 of the L-shaped guide ribs overhang the guide slot 62 opening and overlap undercut walls 68 of the guide channel 64 to vertically retain the shuttling plate 52 to the base housing 14. The width of each guide rib 54 is less than the corresponding guide slot 62 and channel 64 openings. The guide slot 62 and guide channel 64 each comprise a front stop 70 and a rear stop 72 that selectively limit the forward and rearward position of the guide ribs 54 within the slot and channel openings 62 and 64. A plurality of transverse bearing ribs 73 disposed on the bottom of the base housing 14 are configured to slidably support the shuttling plate 52 during operation and minimize friction between the base housing 14 and the shuttling plate 52. Accordingly, when the shuttling plate 52 is assembled to the base housing 14, the guide ribs 54 are configured to slide to and fro between the front and rear stops 70, 72 of the guide slots 62 and guide channel 64 while the shuttling plate 52 is slidably supported by bearing ribs 73 beneath the base housing 14.

Referring now to FIGS. 4-7, the shuttling plate 52 further comprises a plurality of adjacent front and rear nozzle inlets 74, 76 at the left and right sides of the shuttling plate 52. The size of the front and rear nozzle inlets 74, 76 matches the dimensions of the inlet openings 19 in the base housing 14. Accordingly, either of the front or rear nozzle inlets 74, 76 in the shuttling plate can be selectively aligned in fluid registry with the inlet openings 19 in the base nozzle housing to form a part of a working air path between the surface to be cleaned and the downstream suction source 11.

A plurality of debris guides 78 on the bottom surface of the shuttling plate 52 separate the nozzle inlets 74, 76 from front to rear and side to side. Each debris guide 78 comprises a shallow mounting channel 80 (FIGS. 6, 7) and a debris collection element 82 mounted therein to remain in constant contact with the surface to be cleaned as the suction nozzle assembly 10 is translated over the surface to be cleaned. The mounting channels 80 protrude downwardly from the bottom surface of the shuttling plate 52 and are adapted to fixedly receive debris collection elements 82 therein. The debris collection elements 82 can comprise a plurality of tufted strip brushes, elastomeric wipers or squeegee blades, hair collecting elements such as directional fabric strips or resilient, elastomeric blades or nubs, for example. The debris collection elements 82 may be secured within the mounting channels 80 via press-fit, adhesive, ultrasonic welding, or overmolding, for example.

Four sets 84 of elongated debris guides 78 are oriented to direct debris from either a front debris inlet region 92 or a rear debris inlet region 93 formed along the forward and rearward edges 56, 58, respectively, of the shuttling plate 52 towards the front and rear nozzle inlets 74, 76 at the left and right sides of the shuttling plate 52. Each debris guide set 84 comprises an end guide member 86 that divides the front and rear nozzle inlets 74, 76. Each debris guide set 84 additionally comprises an outboard guide member 88 and an inboard guide member 90 that are angled outwardly from the end guide member 86 towards the debris inlet region 92 along the corresponding front or rear edge of the shuttling plate 52. The outboard and inboard guide members 88, 90 associated with the front nozzle inlets 74 are angled outwardly towards the front debris inlet region 92 along the front edge 56 of the shuttling plate 52 whereas the outboard and inboard guide members 88, 90 associated with the rear nozzle inlets 76 are angled outwardly towards a rear debris inlet region 93 located along the rear edge 58 of the shuttling plate. Because the debris inlet region 92, 93 is wider than the nozzle inlet 74, 76 width, a converging debris path 94 is formed from the debris inlet 92, 93 towards the front or rear focused nozzle inlet 74, 76. The debris inlet regions 92, 93 are shaped to decrease the debris path volume from the debris inlets 92, 93 along the edges of the shuttling plate 52 towards the narrow, focused front and rear nozzle inlets 74, 76 at the center of the shuttling plate 52.

Thus, the elongated debris guides 78 extend rearwardly and laterally from the forward end to the front nozzle inlets 74 and extend forwardly and laterally from the rearward end to the rear nozzle inlets 76 to focus the debris to the front nozzle inlets 74 as the suction nozzle moves across a surface to be cleaned in a forward direction and to focus debris to the rear nozzle inlets 76 as the suction nozzle moves across the surface to be cleaned in a rearward direction. The debris guides 78 thus form converging debris paths toward the front nozzle inlet 74 and the rear nozzle inlets 76.

The shuttling plate 52 further comprises a plurality of spaced sheet retention platforms 96, 98 formed on the bottom surface of the flat member 18. The retention platforms 96, 98 are spaced apart and bounded by the four adjoining sets 84 of debris guides 78. The sheet retention platforms 96, 98 are isolated from the front and rear suction nozzle inlets 74, 76 by the adjoining sets of debris guides 84 and are thus, not exposed to the working airflow. A first trapezoidal sheet retention platform 96 is formed at the center of the shuttling plate 52 between adjoining inboard guide members 90. Triangular sheet retention platforms 98 are formed between outboard guide members 88 at both ends of the shuttling plate 52. The sheet retention platforms, 96, 98 are adapted to receive die-cut sheets 100 configured for contacting and dusting the surface to be cleaned. The sheets 100 can comprise felt, directional fabric, micro-fiber fabric, or non-woven electrostatic dusting sheets, for example. The sheets 100 can be secured to the sheet retention platforms 96, 98 by adhesive, hook and loop fasteners, conventional elastomeric sheet retainers, or alternative retention means commonly known in the art.

In operation, a user connects the suction nozzle assembly 10 to a downstream suction source 11 by attaching the swiveling conduit 40 to a conventional suction wand or upholstery hose. The downstream suction source 11 selectively draws a working airflow through the system.

When the nozzle assembly 10 is pushed along the surface to be cleaned in a forward direction (FIG. 6), the debris collection elements 82 beneath the shuttling plate 52 engage the surface to be cleaned and experiences a rearward force thereupon that forces the shuttling plate 52 to slide rearwardly. The plate 52 slides along bearing ribs 73 beneath the base housing 14. The guide ribs 54 on the top, outboard sides of the plate 52 slide rearwardly within the guide slots 62 while the centrally located guide ribs 54 simultaneously slide rearwardly within corresponding guide channels 64. The shuttling plate 52 is vertically retained to the base housing 14 by elongate hooks 60 at the ends of each guide rib 54 that slidably engage the edges of the guide slots 62 and undercut walls 68 of the guide channel 64 respectively. The shuttling plate 52 continues to slide rearwardly until the back of each guide rib 54 contacts a corresponding rear stop 72 in the guide slot 62 and guide channel 64. As the shuttling plate 52 slides rearwardly, the front nozzle inlets 74 align with the inlet openings 19 and thus move into fluid communication with the downstream suction source 11. Alignment of the front nozzle inlets 74 and inlet openings 19, in turn, fluidly connects the debris inlet region 92 and converging debris path 94 with the downstream suction source 11 via the working air chamber 16.

As the nozzle assembly 10 encounters debris on the surface to be cleaned, the debris enters the converging debris path 94 through the front debris inlet region 92 located along the front edge of the shuttling plate 52. Angled outboard and inboard debris guides 78 direct the debris along a converging debris path 94 towards the focused front nozzle inlet 74 in front of the end guide member 86. The working airflow in that region increases in velocity, entrains the debris, and transports the debris through the front nozzle inlet 74. The debris path volume converges towards the focused suction nozzle inlet 74 as the cross-sectional area between the inboard and outboard guide members 90, 88 of each debris guide set 84 decreases closer to the focused suction nozzle inlet 74 resulting in a higher working airflow velocity at the nozzle inlets 74. Accordingly, an intense, high velocity suction flow near the nozzle inlets 74 can enhance debris ingestion and overall performance of the suction nozzle.

The entrained debris is subsequently transported through the working air chamber 16, out of the swiveling conduit 40 and to the downstream suction source 11 where the debris can be separated from the working airflow via a conventional cyclone separator or bag filter as is commonly known in the art.

Figure 7:
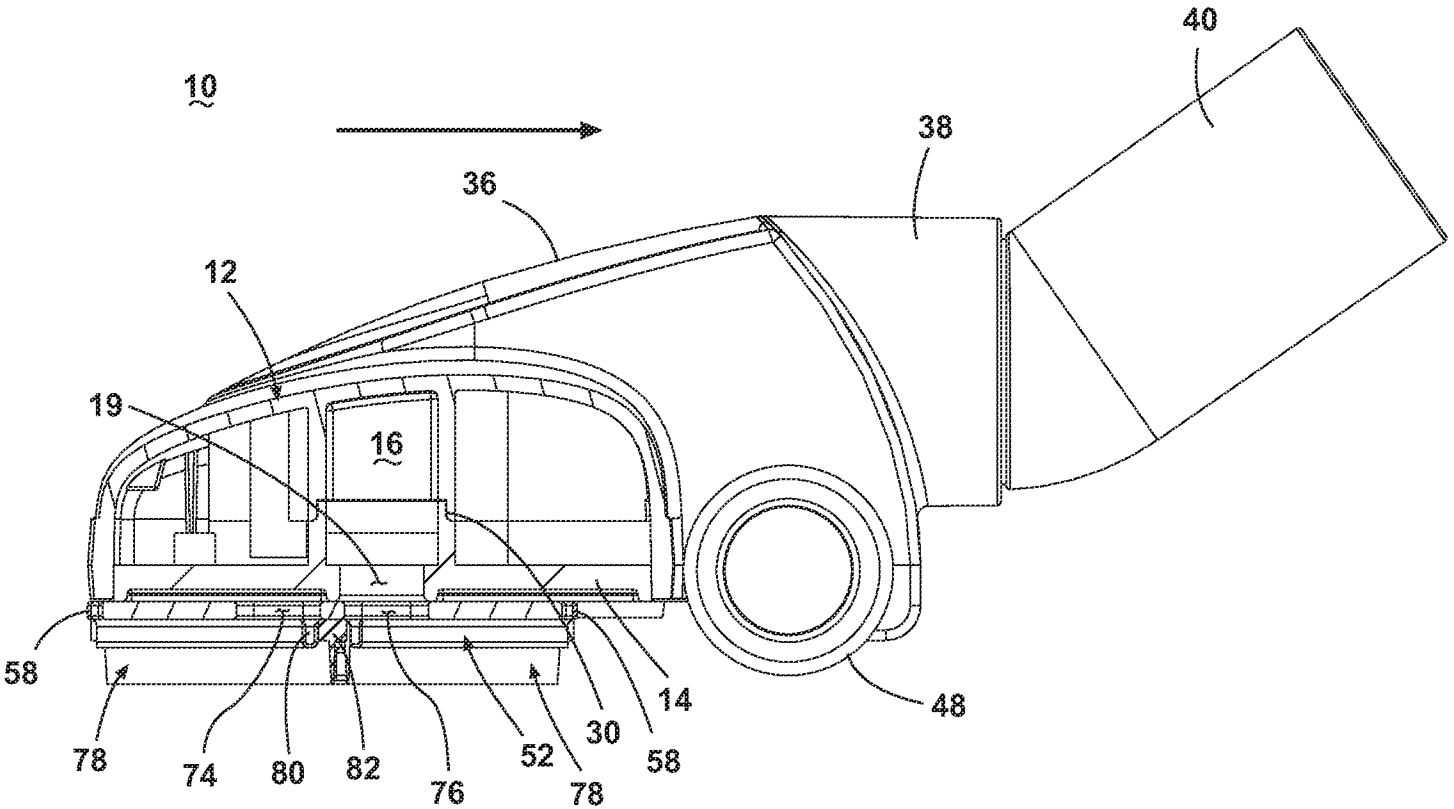
FIG. 7 is a cross-sectional view of the foot assembly taken along line 7-7 of FIG. 5 with a shuttling plate in a forward position during a rearward cleaning stroke.

When a user reverses the cleaning stroke direction and pulls the nozzle assembly 10 backward as depicted in FIG. 7, the debris collection elements 82 engage the surface to be cleaned and push the shuttling plate 52 forwardly along the bearing ribs 73 while the guide ribs 54 engage the guide slots 62. The plate 52 continues to slide forwardly until the front of each guide rib 54 contacts a corresponding front stop 70, whereupon the rear nozzle inlets 76 align with the inlet openings 19 in the base housing 14 thus fluidly connecting rear debris inlet region 93 and converging debris path 94 to the downstream suction source 11. Debris on the surface to be cleaned is introduced to the converging debris path 94 through the debris inlet region 92 and guided to the focused rear nozzle inlet 76 via debris guides 78 associated therewith. The working airflow near the inlet increases in velocity, entrains the debris, and transports the debris through the rear nozzle inlet 76 and towards the downstream suction source 11.

The movement of the shuttling plate 52 in a forward or rearward direction therefore serves the purpose of avoiding distribution of the suction over the full area of the suction nozzle assembly 10. Instead, the working air flow is concentrated in regions where the air flow can have increased effectiveness for entraining and transporting debris towards the downstream suction source. During forward movement of the suction nozzle assembly 10, an effective airflow path includes the front debris inlet region 92 converging to the front nozzle inlet 74. During rearward movement thereof, an effective airflow path includes the rear debris inlet region 93 converging to the rear nozzle inlet 76.

While the suction nozzle assembly 10 is translated in either a forward or rearward direction, the sheets 100 disposed within the sheet retention platforms, 96, 98 are in contact and slide on the surface to be cleaned. As a result, the sheets can capture debris that is too fine to be entrained in the working air flow of the suction source 11.

While the invention has been specifically described in connection with certain specific embodiments thereof, it is to be understood that this is by way of illustration and not of limitation, and the scope of the appended claims should be construed as broadly as the prior art will permit. For example, the suction nozzle assembly can comprise a removable attachment that is configured to be selectively and fluidly connected onto to an existing conventional suction nozzle. The attachment can be fluidly connected to the suction nozzle via press fit, snap fit, or other conventional attachment means. An example of a suitable attachment configuration for a suction nozzle adapter is shown in U.S. Pat. No. 6,101,668, which is incorporated by reference herein. Thus, by selectively connecting the attachment to a conventional suction nozzle, a user can easily convert a conventional suction nozzle into an improved suction nozzle having a shuttling plate, focused suction nozzle inlets, and converging debris paths that is particularly adapted for use on a bare floor as previously described herein.

What is claimed is:

1. A suction nozzle assembly comprising:

a housing with a suction inlet adapted to be interconnected with a suction source, the housing further having a fixed plate mounted to an underside of the housing and having at least one inlet opening fluidly interconnected with a working air conduit; and a shuttling plate having at least one first nozzle inlet and at least one second nozzle inlet and mounted to an underside of the fixed plate for movement between a first position wherein the shuttling plate at least one first nozzle inlet is in fluid register with the fixed plate at least one inlet opening and a second position wherein the shuttling plate at least one second nozzle inlet is in fluid register with the fixed plate at least one inlet opening;

wherein the shuttling plate further comprises on an underside thereof debris guides that are configured to guide debris into the at least one first nozzle inlet when the shuttling plate is in the first position and to guide debris into the at least one second nozzle inlet when the shuttling plate is in the second position.

2. The suction nozzle assembly according to claim 1 wherein the shuttling plate has a forward end, a rearward end and sides that extend between the forward and rearward ends, and the debris guides comprise elongated ribs that extend rearwardly and laterally from the forward end to the at least one first nozzle inlet and that extend forwardly and laterally from the rearward end to the at least one second nozzle inlet to focus the debris to the at least one first nozzle inlet as the suction nozzle moves across a surface to be cleaned in a forward direction and to focus debris to the at least one second nozzle inlet as the suction nozzle moves across the surface to be cleaned in a rearward direction.

3. The suction nozzle assembly according to claim 2 wherein the debris guides form converging debris paths toward the at least one first nozzle inlet and the at least one second nozzle inlet.

4. The suction nozzle assembly according to claim 3 wherein the debris guides further comprise debris collection elements on a bottom portion thereof.

5. The suction nozzle assembly according to claim 4 wherein the debris guides comprise one or more of tufted strip brushes, elastomeric wipers, squeegee blades or hair collecting elements.

6. The suction nozzle assembly according to claim 5 wherein the hair collecting elements include directional fabric strips or resilient, elastomeric blades or nubs.

7. The suction nozzle assembly according to claim 2 wherein at least a portion of the shuttling plate forms at least one retention platform that is configured to be in frictional contact with the surface to be cleaned during forward and rearward movement of the suction nozzle assembly.

8. The suction nozzle assembly according to claim 7 and further comprising at least one debris-collecting fabric mounted to the at least one retention platform in a position to contact the surface to be cleaned to the collect fine dust particles that are not ingested by the first or second nozzle inlets.

9. The suction nozzle assembly of claim 1 and further comprising a plurality of inlet openings in the fixed plate.

10. The suction nozzle assembly of claim 9 wherein the shuttling plate further comprises a plurality of first nozzle inlets.

11. The suction nozzle assembly of claim 10 and further comprising a plurality of second nozzle inlets on the shuttling plate, and each of the plurality of second nozzle inlets are aligned with one of the plurality of first nozzle inlets.

12. The suction nozzle assembly of claim 1 and further comprising at least one debris-collecting fabric mounted to the shuttling plate in a position to contact the surface to be cleaned and configured to collect fine dust particles that are not ingested into the first or second nozzle inlets.

13. The suction nozzle assembly of claim 1 wherein the shuttling plate at least one first nozzle inlet is out of fluid register with any inlet opening in the fixed plate when the shuttling plate is in the second position; and wherein the shuttling plate at least one second nozzle inlet is out of fluid register with any inlet opening in the fixed plate when the shuttling plate is in the first position.

* * * * *